United States Patent [19]

Schoeller et al.

[11] Patent Number: 4,827,709

[45] Date of Patent: May 9, 1989

[54] PROCESS AND APPARATUS FOR LOADING A SPINNING MACHINE WITH ROVING-SUPPLY BOBBINS

[75] Inventors: Leopold Schoeller, Düren; Günter Schulz, Ebersbach; Ernst Halder, Wäschenbeuren, all of Fed. Rep. of Germany

[73] Assignee: Zinser Textilmaschinen GmbH, Ebersbach, Fed. Rep. of Germany

[21] Appl. No.: 128,817

[22] Filed: Dec. 4, 1987

[30] Foreign Application Priority Data

Mar. 24, 1987 [DE] Fed. Rep. of Germany ..... 3709540

[51] Int. Cl.[4] ..... D01H 9/18; D01H 9/00

[52] U.S. Cl. ..... 57/281; 57/268; 57/276; 57/278

[58] Field of Search ..... 57/261, 266, 276–278, 57/279, 281

[56] References Cited

U.S. PATENT DOCUMENTS

| | | | |
|---|---|---|---|
| 3,828,682 | 8/1974 | Klein | 57/281 X |
| 3,935,821 | 2/1976 | Maier et al. | 57/281 X |
| 4,438,622 | 3/1984 | Pons | 57/261 |
| 4,473,997 | 10/1984 | Kawasaki et al. | 57/276 |

FOREIGN PATENT DOCUMENTS

| | | |
|---|---|---|
| 0124662 | 11/1984 | European Pat. Off. . |
| 1131574 | 6/1962 | Fed. Rep. of Germany . |
| 2242361 | 1/1974 | Fed. Rep. of Germany . |

*Primary Examiner*—John Petrakes

*Attorney, Agent, or Firm*—Herbert Dubno

[57] ABSTRACT

In the process and apparatus for loading a ring spinning machine with roving-supply bobbins at least two bobbins rows extending longitudinally on each side of the spinning machine supply roving to the work stations and a auxiliary bobbin row which can travel in with full bobbins and out with empty bobbins are provided. According to our invention an exchange process is provided comprising replacing the roving of the bobbins in one of the bobbins rows supplying the roving which is being consumed by the roving of the auxiliary bobbin row which has been brought in with full bobbins. Thus the auxiliary bobbin row becomes one of the bobbin rows dispensing the roving while the bobbin row being replaced now becomes the auxiliary bobbin row with empty bobbins and is taken away. A new auxiliary bobbin row with full bobbins is then brought in. The exchange process is repeated for each of the bobbin rows as the roving is exhausted. A simple space saving apparatus for performing this process is described.

9 Claims, 8 Drawing Sheets

PROCESS AND APPARATUS FOR LOADING A SPINNING MACHINE WITH ROVING-SUPPLY BOBBINS

FIELD OF THE INVENTION

Our present invention relates to a process and an apparatus for loading a spinning machine with roving-supply bobbins and, more particularly, to a process and apparatus for loading a ring spinning machine with full bobbins and taking away empty bobbins. The invention can also be seen as a process and apparatus for continuously spinning with at least two rovings at each station.

BACKGROUND OF THE INVENTION

A process and apparatus for loading a spinning machine with a plurality of bobbins is known in which at least two bobbin rows extending along each of the sides of the spinning machine dispensing or supplying roving to a plurality of work stations and an auxiliary bobbin row which can travel in with full bobbins and out with empty bobbins are provided.

In the known process two bobbin rows are located in one horizontal plane and a third bobbin row is located in another horizontal plane positioned above the first plane. The bobbin rows in the same horizontal plane supply the ring spinning machine with roving for its work stations (European patent application No. 0124662).

Contrastingly the third bobbin row is continuously equipped with new full bobbins which are transferred by a delivery device to either of the lower bobbin rows as need requires. This process and the apparatus performing this process are correspondingly complicated and need a number of motions or steps to have full roving bobbins always available at the sites at which the roving is supplied to the respective spinning stations.

OBJECTS OF THE INVENTION

It is an object of our invention to provide an improved process and apparatus for loading a spinning machine with roving-supply bobbins which overcomes drawbacks of the earlier systems.

It is also an object of our invention to provide an improved process and apparatus for loading a spinning machine with roving-supply bobbins which continuously supplies the appropriate work stations of the spinning machine with full bobbins and thus roving or the like in a more economical way.

It is another an object of our invention to provide an improved process and apparatus for loading a spinning machine with roving-supply bobbins which continuously supplies the appropriate work stations of the spinning machine with full bobbins in a simpler but space saving way.

SUMMARY OF THE INVENTION

These objects and others which will become more readily apparent hereinafter are attained in accordance with our invention in a process and an apparatus for loading a spinning machine with a plurality of bobbins which has at least two bobbin rows extending along each of the sides of the spinning machine dispensing or supplying roving to a plurality of work stations and an auxiliary bobbin row which travels in with full bobbins and out with empty bobbins.

According to our invention a bobbin exchange process is provided comprising replacing the roving from the bobbins of one of the bobbin rows supplying the roving which is being exhausted by the roving of an auxiliary bobbin row which has been brought in with full bobbins. Thus the auxiliary bobbin row becomes one of the bobbin rows supplying the roving while the bobbin row being replaced now becomes the auxiliary bobbin row with the empty bobbins and is taken away. A new auxiliary bobbin row with the full bobbins is then brought in its place. The exchange process is then repeated for each of the bobbin rows in succession as the roving is dispensed therefrom.

Thus the process according to our invention advantageously eliminates the need to transfer from a standby bobbin row the bobbing to the actual feeder rows but enables the work stations to always be fed from two bobbin rows so that a complicated transfer device and corresponding operating elements can be omitted from the apparatus according to our invention.

To provide the best dispensing conditions for the roving according to our invention the auxiliary or standby bobbin row can be moved into position to become a dispensing bobbin row by longitudinal displacement to the appropriate work stations. It is also advantageous in the interest of continuous operation that the consumption of roving in different bobbin rows be out-of-phase. Thus different full bobbin rows are continuously present so that an undersirable idle condition due to the absence of roving at a particular work station or stations, interrupting machine operation, is avoided.

The apparatus for performing the process can be constructed so that all the bobbin rows can travel in and out independently of each other and a plurality of guide elements for the roving being supplied are located outside the motion path of the bobbin rows. Advantageously the bobbin rows are located in one and the same horizontal plane in one embodiment of our invention. These guide elements are advantageously located in and below spaces between the bobbin rows. However in another embodiment according to our invention a roving guide funnel immediately upstream of the drafting frame can function as one of the guide elements. To simplify and ease the correct positioning of the roving of the full roving bobbins the guide elements can be hook like and attached to telescoping suspended rods. A rapid engagement with the guide element and correct insertion of the roving on it results.

By "guide element" we mean any part or member of the apparatus which is designed to guide the roving into the set of drafting rolls at its work station. This naturally includes the hook like elements with their telescoping rods.

In additional embodiments of our invention the guide elements can be divided into two groups one of which consists of the hook like elements which are adjustable in height. Also the adjustable height guide elements can be acted upon by a pressurized medium.

In another feature of our invention the guide elements in the adjustable height group are mounted on a pivoting arm in the vicinity of the lower portion of one of the bobbin rows.

To align one of the bobbin rows supplying roving at the work stations by longitudinal displacement each bobbin row can be provided with a control device for adjustment to a spindle pitch relative to the associated roving guide funnels. This control device can be mechanical, electrical or acted on by a pressurized medium.

Alternatively in another embodiments of our invention instead of three bobbin rows, four bobbin rows are provided. The four bobbin rows can either be positioned beside each other or at least two bobbin rows can be placed one over the other. In one advantageous embodiment two pairs of adjacent bobbin rows are placed one over the other.

Also in another group of embodiments of our invention two bobbin rows can be placed adjacent each other on one horizontal plane and another bobbin row placed on another horizontal plane below the first horizontal plane.

If the bobbin rows are positioned at different heights in the creel, a plurality of rails of the bobbin rows are combinable with a plurality of feed elements and removal elements. The feed elements and the removal elements can be a plurality of rail segments which are connectable by switching with the rails associated with the bobbin rows. In case these feed and removal elements extend because of a lack of space into the creel, the feed and removal elements are combinable with the rails of the bobbin rows by an adjustable height rail segment.

BRIEF DESCRIPTION OF THE DRAWING

The above and other objects, features and advantages of our invention will become more readily apparent from the following description, reference being made to the accompanying highly diagrammatic drawing in which.

DETAILED DESCRIPTION

Figure 1:
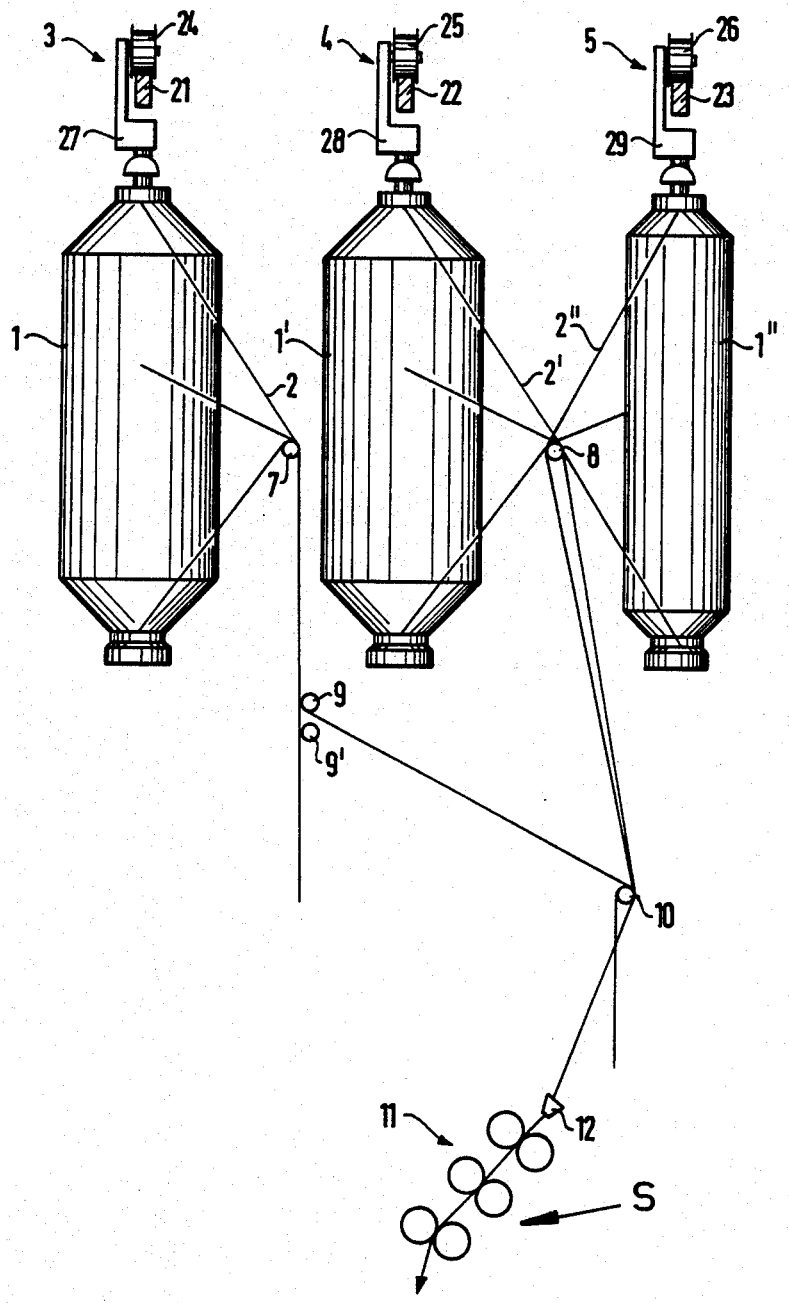
FIG. 1 is a schematic side elevational view of three rows of bobbins above a set of drafting rolls of a ring spinning machine as they are in one embodiment of our invention.

Three bobbin rows 3, 4, 5 positioned in the same horizontal plane are shown in FIG. 1. Bobbins 1, 1', 1'' of the three rows serve one spinning station and have rovings 2, 2', 1'' which can run over guide elements 7, 8, 9, 10 to a roving guide funnel 12 of a schematically shown set of drafting rolls 11 of a ring spinning machine S not further illustrated.

As is apparent from FIG. 1 the guide elements 7, 8, 9, 10 for the roving 2, 2', 2'' are positioned out of the motion paths of the bobbins 1, 1', 1'' (which motion paths are perpendicular to the plane of the paper in FIG. 1) so that the bobbin rows 3, 4, 5 can travel in and out of the machine along the rails 21, 22, 23 without interfering with the running of the roving from the bobbins of the other two rows.

Rollers 24, 25, 26 from which the corresponding bobbins 1, 1', 1'' are suspended run on the rails 21, 22, 23.

As is apparent from FIG. 1 the guide elements 7 and 9 determine the path of the roving 2 from the bobbin 1. The guide elements 8 and 10 determine the paths of the rovings 2' and 2'' to the corresponding roving guide funnel 12. This arrangement is characterized by reduced spatial requirements.

Figure 2:
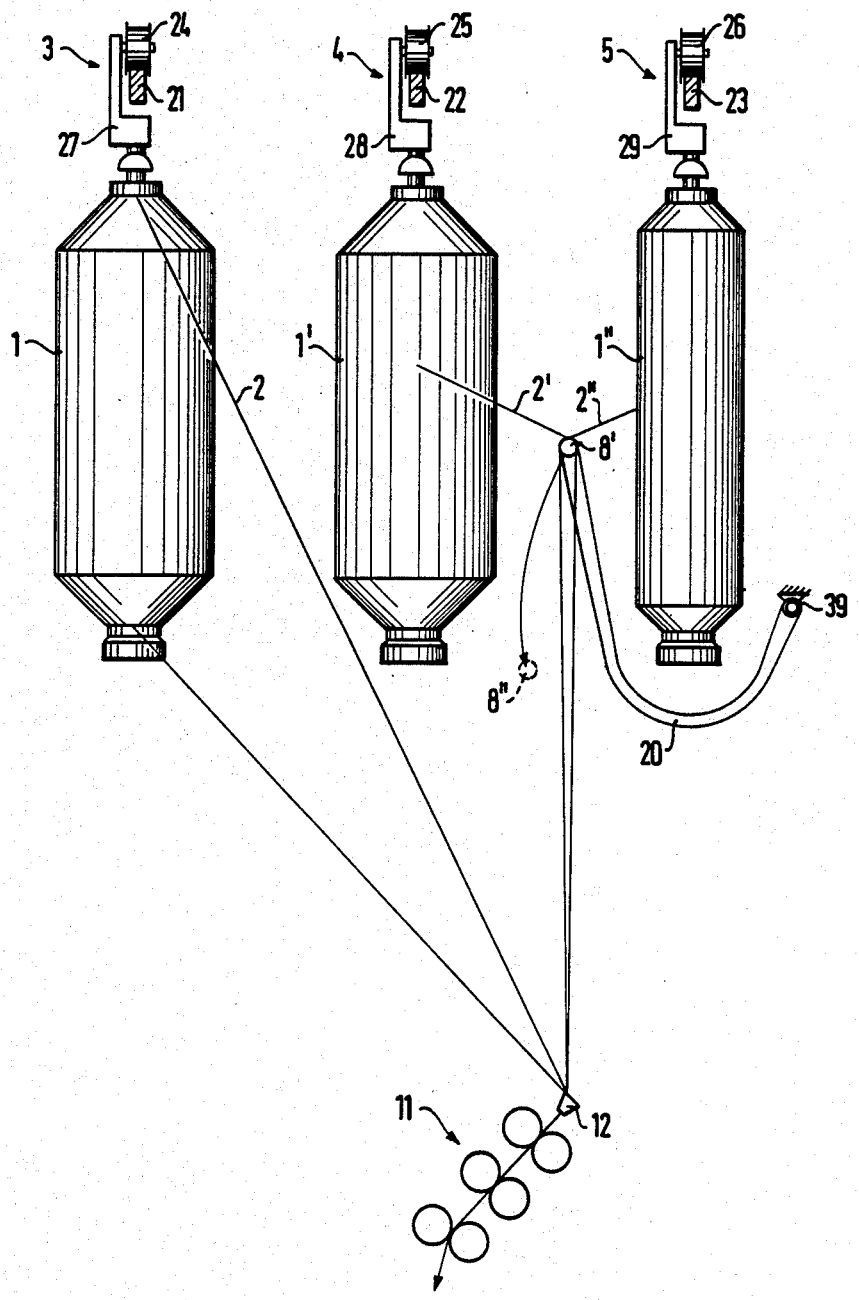
FIG. 2 is a schematic side elevational view of three rows of bobbins similar to FIG. 1 as they are in another embodiment of the apparatus of our invention.

In the embodiment according to FIG. 2 only the guide elements 8' is provided in addition to the guide funnel and the element 8' located. The space between the bobbin rows 4 and 5 for each set of bobbins serving a spinning station. In this embodiment the roving 2 of the bobbin 1 of the bobbin row 3 runs directly to the corresponding roving guide funnel 12 which thus functions as a guide element. Thus the bobbin 1 must be moved further from the bobbin 1' to provide a path for the roving from bobbin 1 which does not interfere with the movement of bobbin row 4. The larger spatial requirement needed because of that is compensated by the omission of the seperate guide elements for the roving 2 of bobbin row 3.

To simplify the manuel insertion of the roving 2' and the roving 2'' through the guide element 8', in the embodiment according to FIG. 2 the guide element 8' is mounted on a pivoting arm 20. This pivoting arm 20 can pivot about its pivot point 39 which is provided below the bobbin row 5, e.g. in a counterclockwise direction into the lower position 8''. Thus the insertion of the roving into the guide element is facilitated then the pivoting arm 20 swings back into its operating position, i.e. into its upper position, so that the entire configuration is again able to function.

Figure 3:
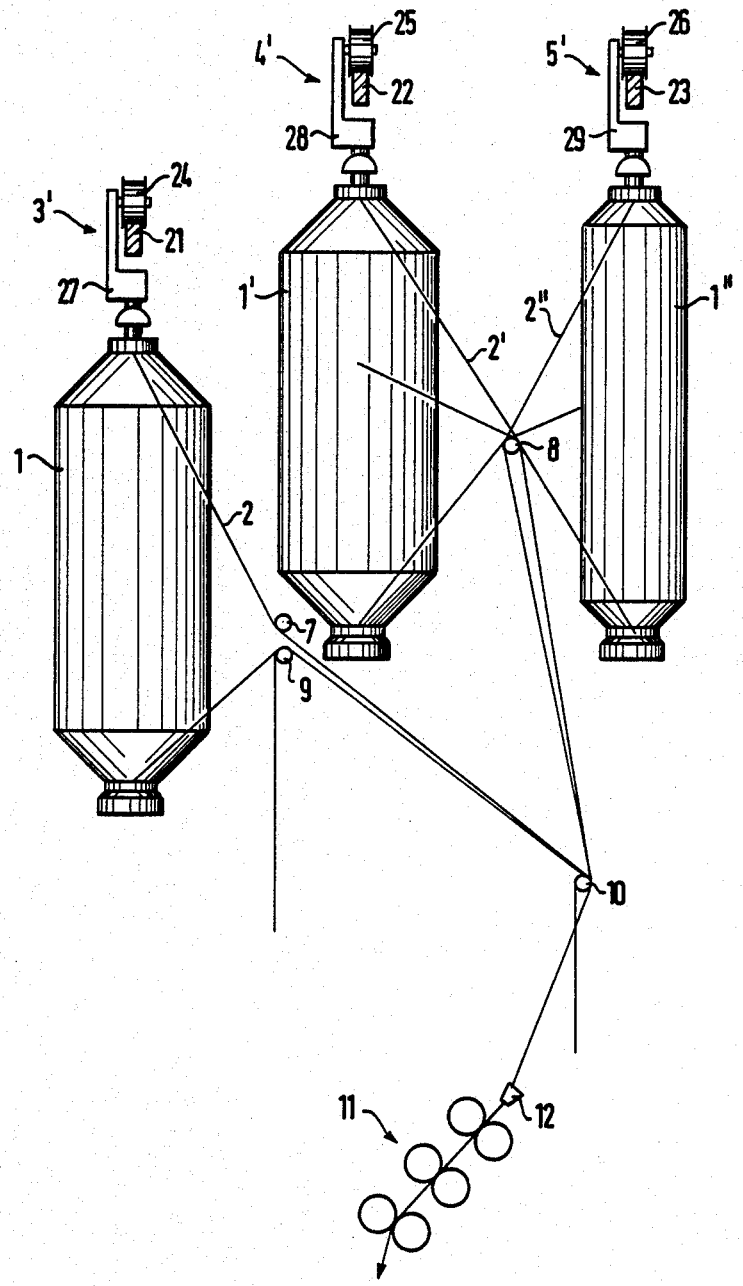
FIG. 3 is a schematic side elevational view of three rows of bobbins with bobbin rows at various heights in a further embodiment according to our invention.

In the embodiment according to FIG. 3 two bobbin rows 4' and 5' are positioned in one horizontal plane and the third bobbin row 3' is positioned in another horizontal plane. Again the guide elements 7, 8, 9, 10 are provided to guide the corresponding roving 2, 2', 2'' to the related roving guide funnel 12 so that the individual bobbin rows 3', 4', 5' can each travel in and be displaced into and out of the machine perpendicular to the plane of the paper in FIG. 3 without interference with the running of The roving from the other two rows. This arrangement has a reduced need for space in regard to its width however the rail 21 must be at a different height from those of bobbin rows 4' and 5'.

In operation, when roving fed from the bobbins of one of the two roving-supplying bobbin rows runs out of the roving 2, 2' or 2'' of that row is replaced by roving from the third bobbin row which has previously been brought in with full bobbins but movement perpendicular to the plane of the paper in FIGS. 1–3, and this bobbin row then becomes a roving-supplying or dispensing bobbin row while the bobbin row from which roving has been consumed by movement perpendicular to the plane or has empty bobbins which are taken away and full bobbins are brought in the paper in FIGS. 1–3.

This exchange process is repeated sequentially for all the bobbin rows.

Here the consuming of roving dispensed from a bobbin row need not occur in phase with the roving of the other bobbin rows, i.e. it can occur out-of-phase. In the embodiments shown in FIGS. 1 to 3 for example the furthest bobbin row 5 and/or 5' runs empty first so that after its consumption this bobbin row 5 and/or 5' is moved from the work stations and is replaced by a new bobbin row provided with full bobbins 1".

In the embodiment according to FIG. 2 the guide elements 8' between the bobbin rows 4 and 5 are each mounted on a pivoting arm 20.

Figure 4:
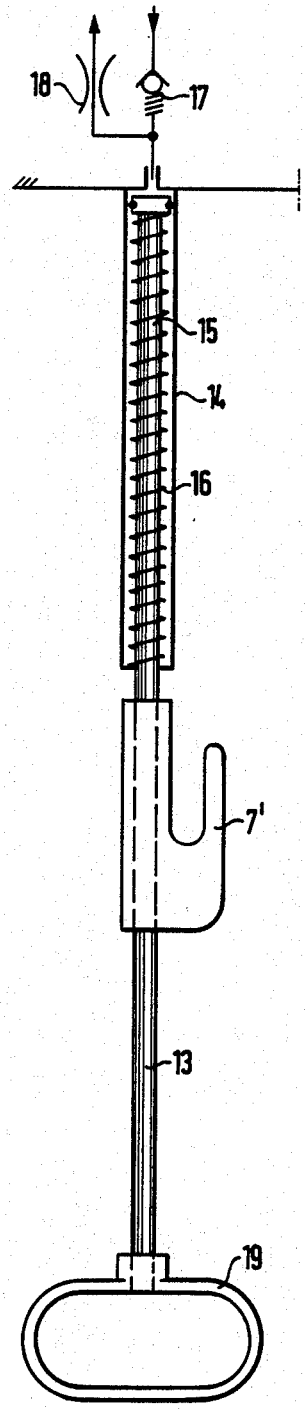
FIG. 4 is a schematic side elevational view of a vertically movable guide element in one embodiment of the apparatus according to our invention.

It is also possible in another embodiment of our invention to arrange the corresponding guide elements on a telescoping suspended rod. According to FIG. 4 this guide element 7' is attached to a telescoping rod 13. A handle 19 is located on the lower portion of this rod 13. This rod 13 is connected with a piston rod 15 which runs inside a cylinder 14 in which a spring 16 is located.

By pulling downwardly on the handle 19, the hooklike guide element 7' for the appropriate roving is moved downwardly from the operating position in which the roving is manually laid into the guide into the setting up or guiding in position. Then a pressurized medium is drawn into the cylinder 14 through a schematically illustrated nonreturn valve 17. After the appropriate roving is inserted into the guide 7' the handle 19 is released by the operator. The spring 16 moves the rod 13 upwardly so the guide element 7' reaches the operating position and the pressurized medium is displaced from the cylinder 14 through a schematically shown throttle 18. Also by this structural form an ease of operation for the operator with a correctly functioning feed of the roving in the guide element 7' is guaranteed.

Figure 5:
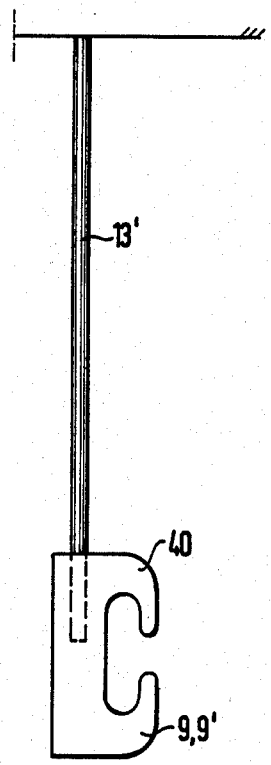
FIG. 5 is a schematic side elevational view of another embodiment of a guide element in our invention.

FIG. 5 shows another embodiment of a guide element 9 and/or 9' which is only mounted on a rod 13' which supports the configuration at the locations 9 and/or 9' at the lower left in FIGS. 1 and 3 suspended above the ring spinning machine S. The lower guide element 9, 9' in the embodiment according to FIG. 1, also in that of FIG. 3, has the purpose of preventing the dropping of the end of the roving being dispensed to the set of drafting rolls 11. In this embodiment the guide element 9 and/or 9' has an upper hooklike portion 40.

Figure 6:
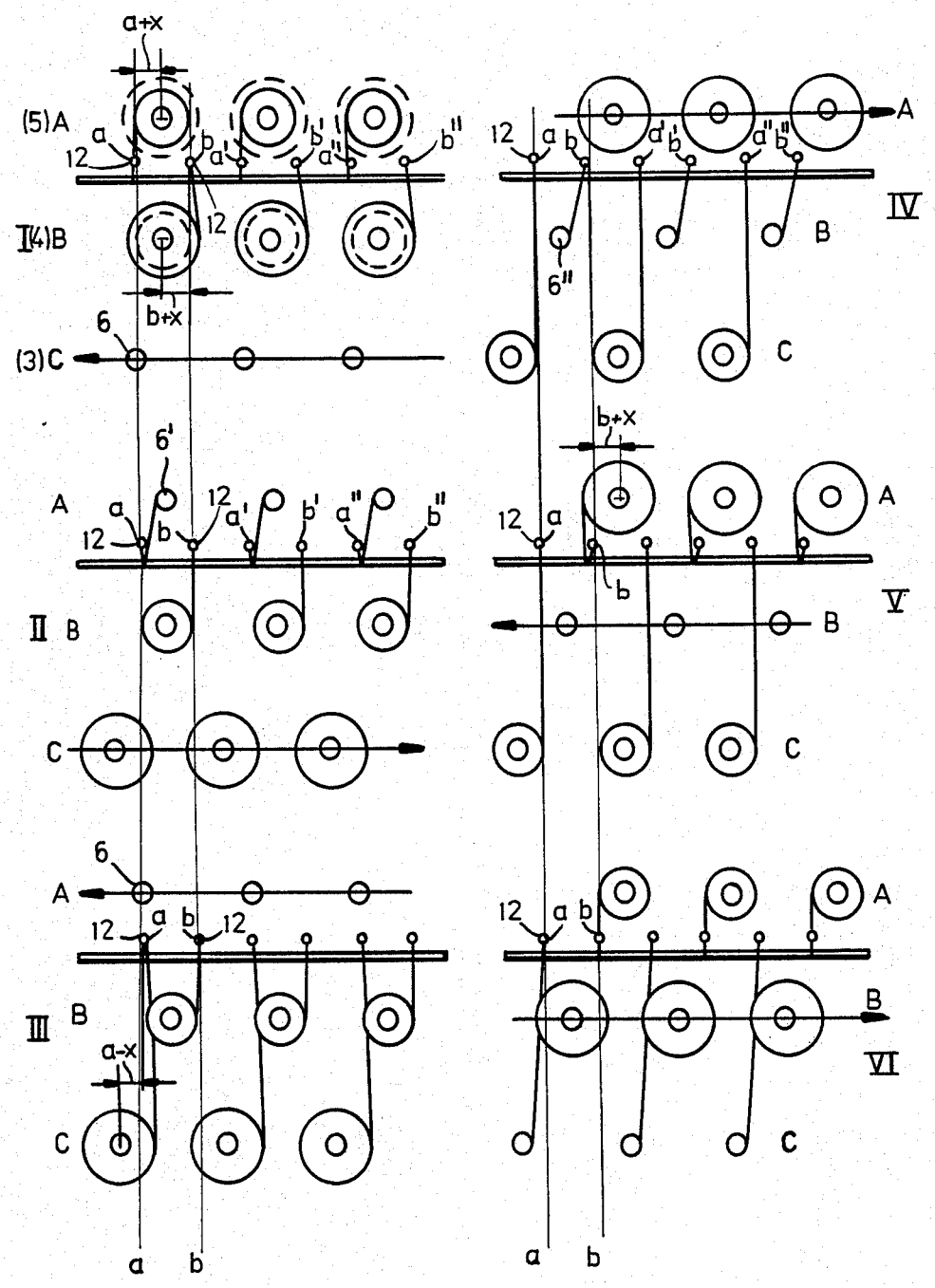
FIGS. 6 (I)–6 (XII) are schematic top plan views of various positions adjustable over one spindle pitch (spindle spacing per rows) relative to the associated roving guide funnels of each of the three bobbin rows.
Figure 6:
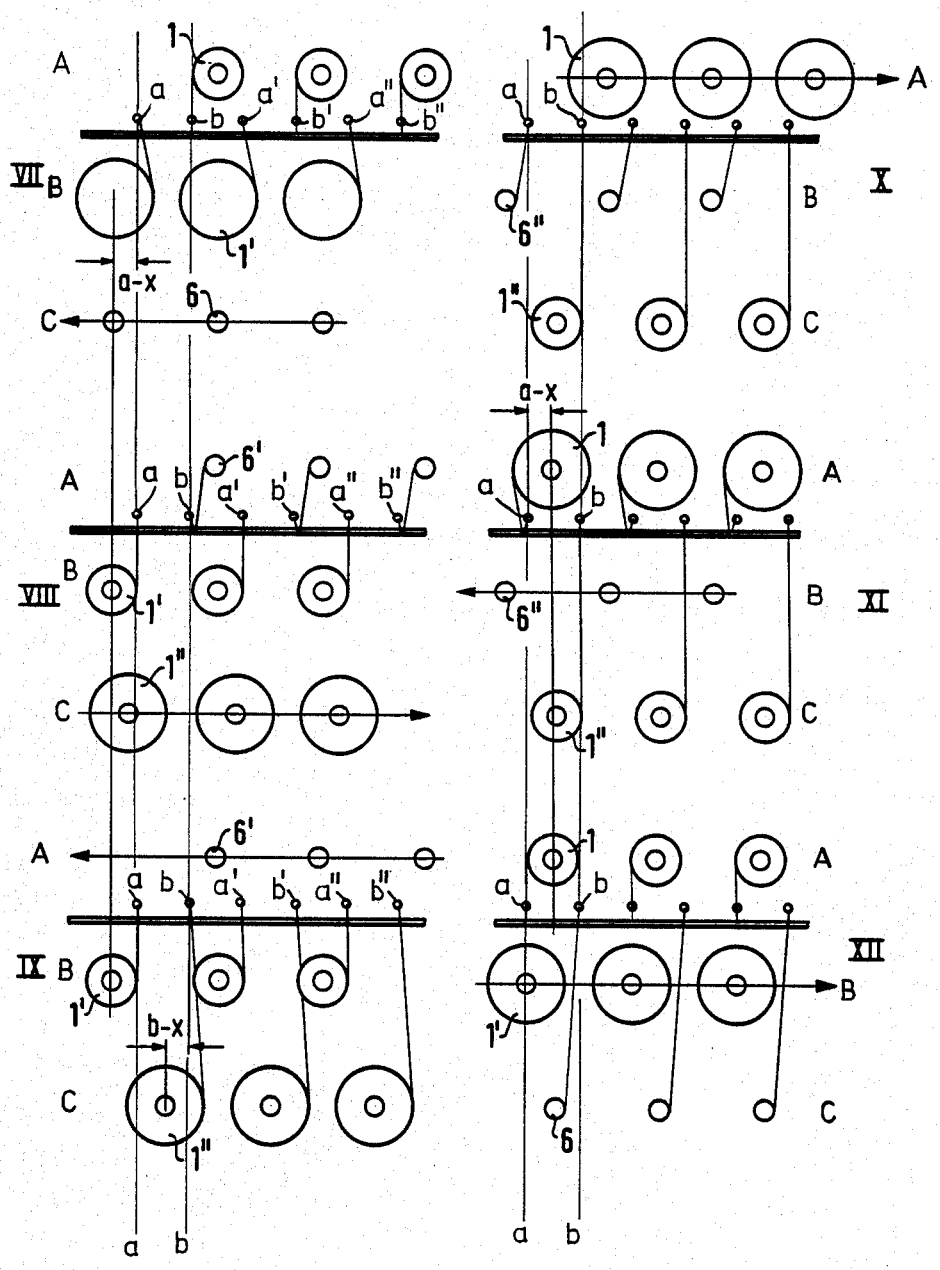

In FIGS. 6 (I) to 6 (XII) the operating stages I to XII of the bobbin exchange process in which three bobbin rows are exchanged are shown schematically. As is apparent the bobbin row C (analogous to bobbin row 3 according to FIGS. 1 to 3) runs out so that empty bobbins 6 are present. This empty bobbin row C is moved away in the direction of the arrow. The bobbin rows A and B (similar to bobbin rows 4 and 5 in the embodiment according to FIGS. 1 to 3) supply roving to the roving guide funnels 12 of the ring spinning machine S.

According to the working configuration II the empty bobbins of the bobbin row C are replaced by full bobbins. The bobbin row A then comprises nearly empty bobbins 6'. The bobbin row B is half empty. As is apparent the roving of the bobbin rows A and B take other angular positions relative to the roving guide funnels 12 than in working configuration I.

According to the working configuration III the bobbin row A is exhausted so that the bobbins 6' of the bobbin row A are taken away. Now the associated roving of the bobbin row C is guided into the appropriate roving guide funnels 12. According to working configuration IV the bobbin row A again is equipped with full roving bobbins. In this working configuration the bobbins 6" of the bobbin rows B are about to run empty and in these positions the bobbin rows A and C feed their roving to the roving guide funnels 12.

As is apparent a displacement of the bobbin rows A, B and C relative to the positions a, b, a', b' and/or a" and b" of the roving guide funnels 12 of about +x and/or −x is provided to attain continuously a satisfactory angular orientation of the roving being fed in in regard to the position of the roving guide funnels 12. While in the working configuration I the roving of the bobbin row A is fed in the roving guide funnels 12 in the positions a, a' and/or a" but when in the working configuration V the roving is fed in the positions b, b', b" while in this configuration the bobbin row C works in the openings a, a', a" and an exchange of the bobbins 6" of the bobbin B occurs.

In the working configuration VII the bobbin row B is shifted an amount equal to a-x. The bobbin row A and B supply roving while the bobbins 6' are running empty or being exhausted and according to the working configuration IX and X the bobbin row A runs empty and is substituted by full bobbins. In the working configurations XI and XII, a displacement of the bobbins of the bobbin row A an amount a-x occurs to attain a satisfactory feed in angle for the roving of the full and/or half full bobbins.

Figure 7:
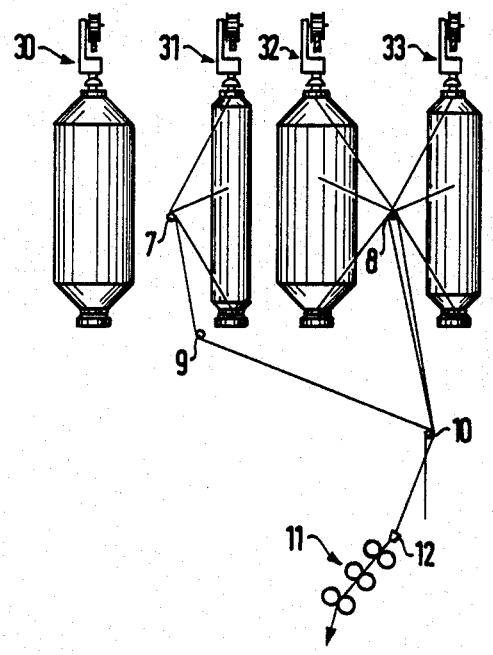
FIG. 7 is a side elevational view of another embodiment of our invention with four bobbin rows positioned side by side.
Figure 8:
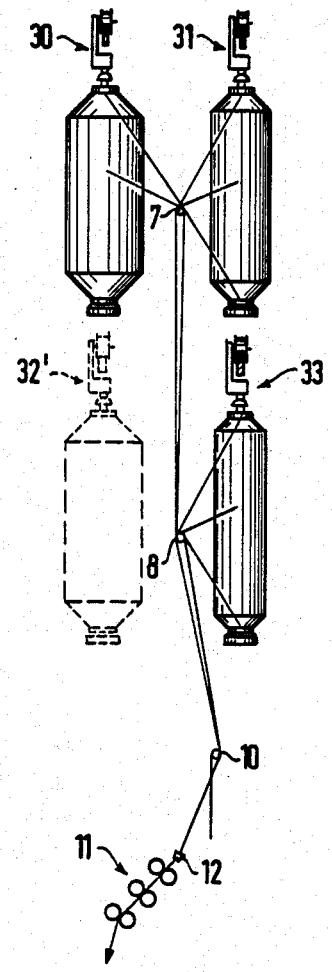
FIG. 8 is a side elevational view of an auxiliary embodiment of our invention with two adjacent spindle rows positioned one above the other.

In the embodiments according to FIGS. 1 to 6 three bobbin rows are used. As shown in FIGS. 7 and 8, four bobbin rows 30, 31, 32 and 33 can be used instead. According to FIG. 7 these bobbin rows are positioned in a horizontal plane. Again guiding elements 7 and 8 and/or 9 and 10 are provided. As is apparent also the consuming of the bobbin rows 30 to 33 occurs out-of-phase. In the configuration shown in FIG. 7 the roving bobbin 31 is nearly exhausted.

According to FIG. 8 two adjacent pairs of bobbin rows 30 and 31 and/or 32' and 33' are positioned one above the other and suitably roving is guided therefrom by guide elements to the roving guide funnels 12 in front of the entrance of the drafting rolls 11.

Figure 9:
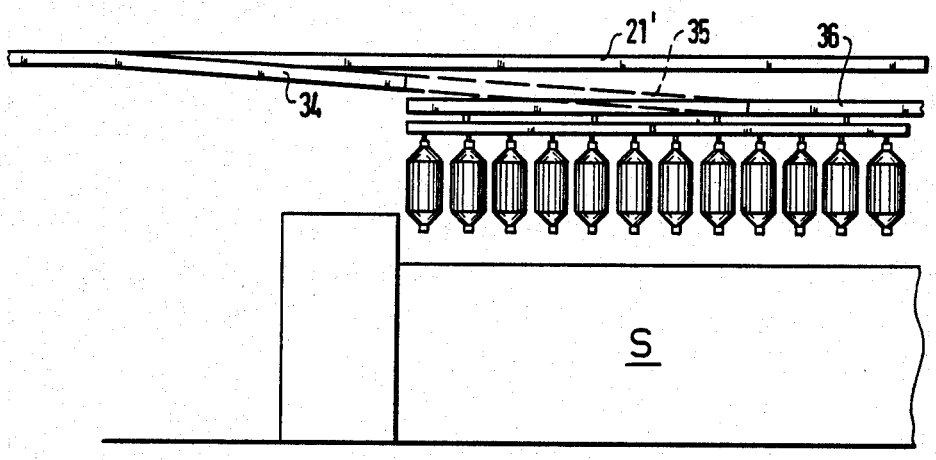
FIG. 9 is a schematic side elevational view of a conveying device for conveying bobbins to the bobbin rows.
Figure 10:
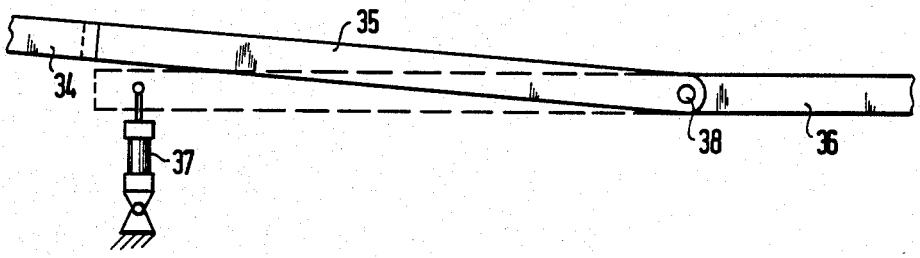
FIG. 10 is a schematic side elevational view of another embodiment of the conveying device shown in FIG. 9.
Figure 11:
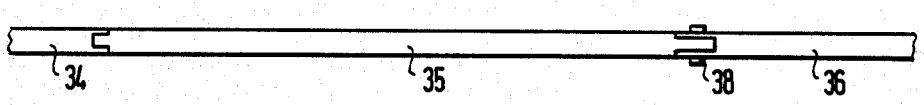
FIG. 11 is a top plan view of the device shown in FIG. 10.

In FIGS. 9 to 11 a conveyor system for bringing in full bobbins and/or taking away empty roving bobbins is shown. As is apparent a rail 36 is connected with an inclined rail 34 by an adjustable height rail segment 35 which is rotatable about a pivot point 38 and which is acted on by a piston cylinder unit 37.

The full bobbins located on the rail 21' according to FIG. 9 can be transported to the rail segment 35 connected to the rail 36 by switching and thus to a working position above the ring spinning machine S. This allows the bobbin rows to be located in a creel at different heights. Thus ascending and/or descending portions or segments of rails such as rail segment 35 which connect to rails in the creel at heights different from the normal height for feeding bobbins in and taking them away must be provided.

In this case an adjustable height rail segment 35 according to one embodiment according to FIGS. 9 to 11 is provided. In each case an automatic conveyor system results in which by control devices it is guaranteed that full bobbins are taken to the correct location at the correct time and that empty bobbins are taken away.

By "feed and removal elements" in the following claims we mean members or parts of the apparatus which assist the bobbins in reaching or leaving the rails above the spinning machine. In particular the inclined rail 34 is an embodiment of these feed and removal elements.

We claim:

1. A process for continuously feeding roving to a spinning machine, having a longitudinal axis and comprising at least three bobbin rows extending along each side of said spinning machine parallel to said axis and movable independently of one another into and out of said machine in a direction along the respective row, each of said rows having a plurality of bobbins, at least one of said rows having full bobbins, and guide means for forming paths for roving from said bobbin rows to respective work stations of the machine, said process comprising the steps of:

(a) dispensing roving to a plurality of work stations, respective bobbins assigned to each work station from a first and second row of said bobbins, so that roving from the bobbins of the first row is consumed before the roving supplied by the bobbins of the second row;

(b) connecting roving from full bobbins of a third row having full bobbins upon exhaustion of the roving from the bobbins of the first row through respective guide means to the respective station for continuous feeding of said roving thereto;

(c) horizontally shifting said first row with exhausted bobbins out of said machine in a direction along said first row while positioning said guide means so that paths of said roving are out of the path of the shifting of the bobbins of the first row;

(d) shifting full bobbins into the machine along said first bobbins row while the bobbins of said second and the third rows continuously supply the work stations with said roving; and (e) repeating steps (b), (c) and (d) to sequentially empty, remove and replace bobbing of said second, third and first rows in a respective succession.

2. An apparatus for continuously feeding roving into a spinning machine having an elongated base with a longitudinal axis and a plurality of work stations with a plurality of bobbins, comprising:

a first, second and third bobbin rows extending along each side of the spinning machine parallel to the longitudinal axis of the base and movable independently relative to one another defining a motion path of each row parallel to said axis, so that while bobbins of said first and second rows supply the work stations with roving, the third bobbin row has full bobbins ready to supply respective stations without transfer to the first and second rows;

guiding means located out of the motion path of said rows for routing paths to the work stations, so that said paths of roving do not intercept paths of the rows; and transfer means for shifting the first bobbin row along said motion path upon exhaustion of roving of bobbins of said first row and for replacing the bobbins of the first row with consequent shifting said row with full bobbins along the motion path of said first row while said third bobbin row and said second bobbin rows simultaneously supply the work stations with roving, so that the transfer means sequentially shifts each of said first, second and third bobbin rows along the respective motion paths upon exhaustion of roving of each of said bobbin rows while two others of said bobbin rows continuously supply the working stations with the roving.

3. The apparatus defined in claim 2 wherein said rows of bobbins are located in the same horizontal plane.

4. The apparatus defined in claim 2 wherein at least one of said rows is in a different horizontal plane from a horizontal plane of two other bobbin rows.

5. The apparatus defined in claim 2, comprising a further row at each of said sides of the spinning machine and four bobbin rows at each of the sides are arranged in two pairs located in two horizontal planes one above another, so that at least one of said rows is the row with full bobbins.

6. The apparatus defined in claim 2 wherein said guiding means comprises:

a plurality of adjustable height hook elements each mounted on a telescoping rod, and a plurality of roving guide funnels.

7. The apparatus defined in claim 6 wherein each of said telescoping rods includes a piston-and-cylinder unit having a piston actuated by a pressurized medium drawn into a cylinder of said piston-and-cylinder unit.

8. The apparatus defined in claim 6 wherein said adjustable height hook elements are located on a portion opposite journaled portion of a pivoting arm juxtaposed with one of said bobbin rows so that said hook elements are pivotable with said arm redefining the paths of said rovings for different combinations of said bobbin rows.

9. The apparatus defined in claim 2 wherein said transfer means comprises:

respective rails defining the path of each of said bobbin rows;

a plurality of rail segments above said rails; and means for selectively connecting said rails with one of said rail segments, so that said rows with exhausted bobbins are replaced by rows with full bobbins.

* * * * *